US006575332B2

(12) United States Patent
Abergel et al.

(10) Patent No.: US 6,575,332 B2
(45) Date of Patent: Jun. 10, 2003

(54) FLUID PRODUCT DISPENSER

(75) Inventors: Aline Abergel, Boulogne Billancourt (FR); Frédéric Duquet, Evreux (FR); Firmin Garcia, Evreux (FR); Hervé Pennaneac'h, Verneuil-sur-Avre (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/985,399

(22) Filed: Nov. 2, 2001

(65) Prior Publication Data

US 2002/0056732 A1 May 16, 2002

(30) Foreign Application Priority Data

Nov. 3, 2000 (FR) ..... 00 14197

(51) Int. Cl.[7] ..... B65D 35/56

(52) U.S. Cl. ..... 222/105; 222/107; 222/179.5; 222/183; 222/541.6; 222/541.8

(58) Field of Search ..... 222/190, 209, 222/211, 92, 94, 105, 107, 131, 179.5, 160, 182, 183, 325, 538, 541.6, 541.1; D9/302, 305, 306; 206/210, 387, 459, 812, 815, 540

(56) References Cited

U.S. PATENT DOCUMENTS 1,008,195 A * 11/1911 Prichard ..... 222/179.5
3,269,604 A * 8/1966 Serry ..... 222/105
4,043,448 A * 8/1977 Tanaka ..... 206/210
4,987,999 A * 1/1991 Hehn ..... 206/387
5,080,222 A * 1/1992 McNary ..... 206/540
5,531,325 A * 7/1996 Deflander et al. ..... 206/812
5,839,609 A * 11/1998 Zakensberg ..... 206/484
5,938,013 A * 8/1999 Palumbo et al. ..... 206/210
6,478,195 B2 * 11/2002 Duquet et al. ..... 222/183

FOREIGN PATENT DOCUMENTS

| | | |
|---|---|---|
| FR | 1 527 556 | 11/1968 |
| FR | 2 784 361 A | 4/2000 |
| GB | 2 296 700 | 7/1996 |

* cited by examiner

*Primary Examiner*—Kevin Shaver
*Assistant Examiner*—Stephanie L. Willatt
(74) *Attorney, Agent, or Firm*—Sughrue Mion, PLLC

(57) ABSTRACT

Fluid product dispenser, including a fluid product pack (2) defining a fluid product container, a dispensing orifice, and a removable sealing part (25) sealing the dispensing orifice; and a case (1) wherein the fluid product pack (2) is inserted by sliding so as to take the pack out of its case to remove the removable sealing part. The fluid dispenser also includes a stopping feature (16, 26, 265) to limit the sliding of the pack in the case.

16 Claims, 2 Drawing Sheets

FLUID PRODUCT DISPENSER

FIELD OF THE INVENTION

The present invention relates to a fluid product dispenser comprising a fluid product pack intended to contain a fluid product and a case wherein the fluid product pack is housed.

BACKGROUND OF THE INVENTION

Such a dispenser is particularly described in the document WO 00/21853 which describes a dispenser incorporating a pack in the form of a thermoformed body covered with a film. The body of the pack is also covered by a flap which partially or completely masks the body. A part of the flap may also extend onto the film which forms the rear face of the pack. In other words, the pack is placed inside a case which partially or completely masks the body. A part of the flap may also extend onto the film which forms the rear face of the pack. In other words, the pack is placed inside a case which partially or completely covers the pack. The pack, in addition to defining a container for the fluid product, also defines a dispensing orifice which is sealed before the first use with a removable sealing part intended to be folded back, broken or torn off to reveal the dispensing orifice. The removable sealing part is composed of a part connected to the body and the covering film. The flap covering the pack on the side of the thermoformed body does not extend onto the removable sealing part such that it remains permanently uncovered and accessible.

Another document of the prior art, i.e. the document DE 9309740 on which the foreword of the main claim is based, describes a dispenser of the same type comprising a fluid product pack placed in a case. Unlike the above-mentioned document of the prior art wherein the pack is attached inside the case, in this case, the pack is mounted sliding inside the case such that it is possible to take the pack out of the case. The pack is kept inside the case by inserting a raised surface formed by the body inside a slot in the case. In this document, no way of opening the pack is described. In any case, the pack comprises a dispensing orifice sealed before use by a removable part. Said removable part may be a part of the body and/or the film or a tab glued onto the dispensing orifice, that may be removed to form or uncover a dispensing orifice connected to the container.

To open the pack in this German document, it is necessary to extract the pack from the case completely as shown in the single figure in this document. Therefore, the sliding of the pack inside the case is completely free and unlimited. As a result, once the pack has been taken out of its case, the user has two separate items, the pack and the case, and it is necessary to reinsert the pack into the case to restore to the dispenser to its original state, which may be a relatively complicated operation. The user will tend to discard the case which is not of great use after the first use of the dispenser. Therefore, the case only contributes to the dispenser's aesthetic effect when not in use.

SUMMARY OF THE INVENTION

The aim of the present invention is to improve such a fluid product dispenser such that it is possible to open the pack without dismantling the dispenser. Another aim of the present invention is to retain the aesthetic effect of the dispenser even after the pack has been opened. Another aim is to enable easier opening of the pack by encouraging the user to opt for a specific opening operation.

These aims are achieved according to the invention by means by a fluid product dispenser comprising:

- a fluid product pack defining a fluid product container and a dispensing orifice, and a removable sealing part sealing the dispensing orifice,
- a case wherein the fluid product pack is inserted by sliding so as to take the pack out of its case to remove the removable sealing part,
- characterised in that stopping means are provided to limit the sliding of the pack in the case.

Therefore, it is not possible to take the pack completely out of the case simply by sliding. The case, which advantageously forms a sheath open at two opposite ends, offers access to the pack such that the user can pull or push the pack to slide it in the case. The invention provides for pull-type or push-type sliding stopping means on the pack to take it out of the case. Therefore, it is possible to slide the pack in the case over a limited distance which advantageously corresponds to the width of the removable sealing part so as only to uncover the removable sealing part when sliding comes to a stop.

According to a practical embodiment, the pull-type or push-type stopping means may comprise at least one slide inserted in a respective slot comprising at least one first slot end against which the slide comes to a stop at the end of sliding.

If the case can be pulled, it may advantageously comprise holding means to be able to hold the pack to pull it out of the case. According to a practical embodiment, the holding means comprise a slot in the case showing the pack to hold it at the sealing part. It is thus possible to hold the removable sealing part of the pack to pull it to a limited extent out of the case. It is also possible to use slides projected out of the slots of the case to move the pack in the case. In this case, the slides serve both as stopping means in conjunction with the slots and holding means to move the pack in the case.

Alternatively or in combination with the slide system inserted in a slot, the push-type stopping means may comprise a notch in the case uncovering the pack to be able to push it. The notch is used to push the pack using a finger to slide it in the case so as to take the removable sealing part out of the case at the other end. The slide stopping system inserted in a slot may be associated with this notch such that the user pushes the pack by inserting their finger in the notch until the slide comes to a stop on the first end of the slot. Alternatively, the slide system may be omitted and the insertion of the user's finger into the notch continues until the finger comes to a stop at the rear of the notch. In this case, the rear of the notch forms the push-type stopping means.

According to an additional characteristic, the pull-type stopping means may comprise push-type sliding prevention means on the pack to take it out of the case. Symmetrically, the push-type stopping means may comprise pull-type sliding prevention means on the pack to take it out of the case. In a practical embodiment, the prevention means may comprise at least one slide inserted in a respective slot comprising a second slot end against which the slide is at a stop at the start of sliding. The prevention means, which form the initial stopping means, impose on the user one obligatory push-type or pull-type sliding direction. For example, in the case of pull-type sliding, the user who has initially tried to push on the pack will immediately understand that it is necessary to pull the pack to remove the removable sealing part from the case. This may be transposed symmetrically to the case of push-type sliding. The user is thus fully assisted in the use of the fluid product dispenser according to the invention. In one direction, the pack cannot slide, and in the other direction, it can only slide in a limited fashion.

BRIEF DESCRIPTION OF THE DRAWINGS

The invention will now be described in more detail with reference to the figures attached giving non-restrictive examples of two embodiments of the invention.

In the figures.

DETAILED DESCRIPTION OF THE INVENTION

Figure 1:
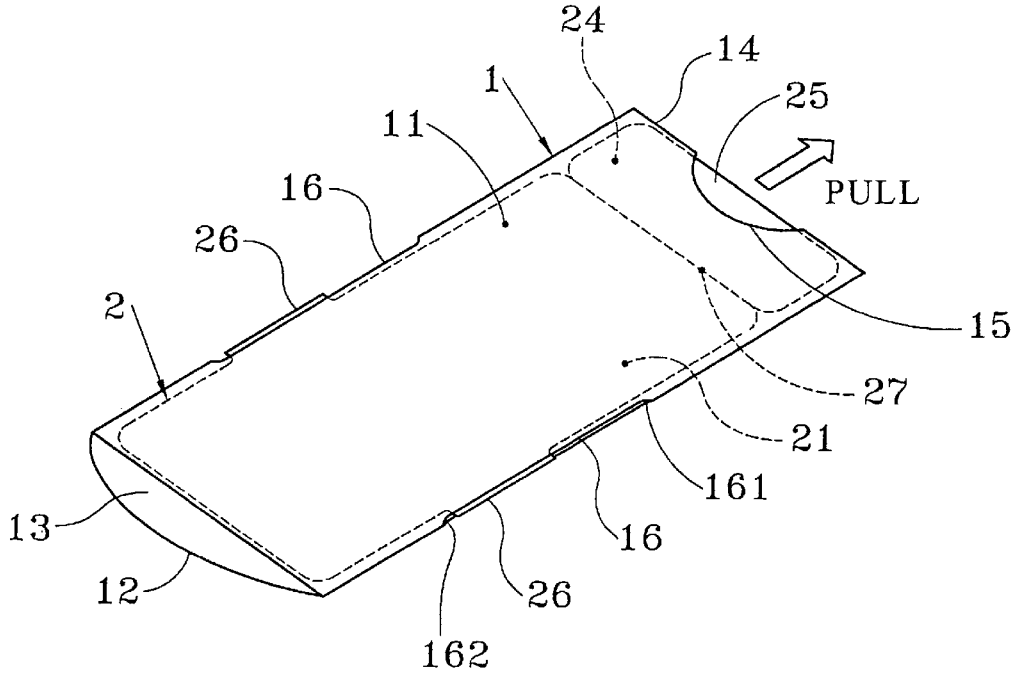
FIG. 1 is a schematic perspective view of the rear of a dispenser according to a first embodiment of the invention showing the pack inside the case, the dispenser being still in an unused state in storage.

In the two embodiments shown in the figures, the fluid product dispenser according to the invention comprises two constituent parts, i.e. a case 1 and a pack 2 arranged in a sliding fashion inside the case 1. The case 1 is shown here in the form of a sheath surrounding the pack 2, leaving two opposite ends 13 and 14 open. In practice, the case 1 may be produced from a sheet of foldable flexible material folded on itself and, for example, glued along two opposite longitudinal edges. In the embodiments shown, the case 1 comprises a convex front face 12 and a plane rear face 11. The case shows a slightly tapered shape with the open ends 13 and 14 located on the shortest sides which the faces 11 and 12 and folded together on the longest sides.

Figure 2:
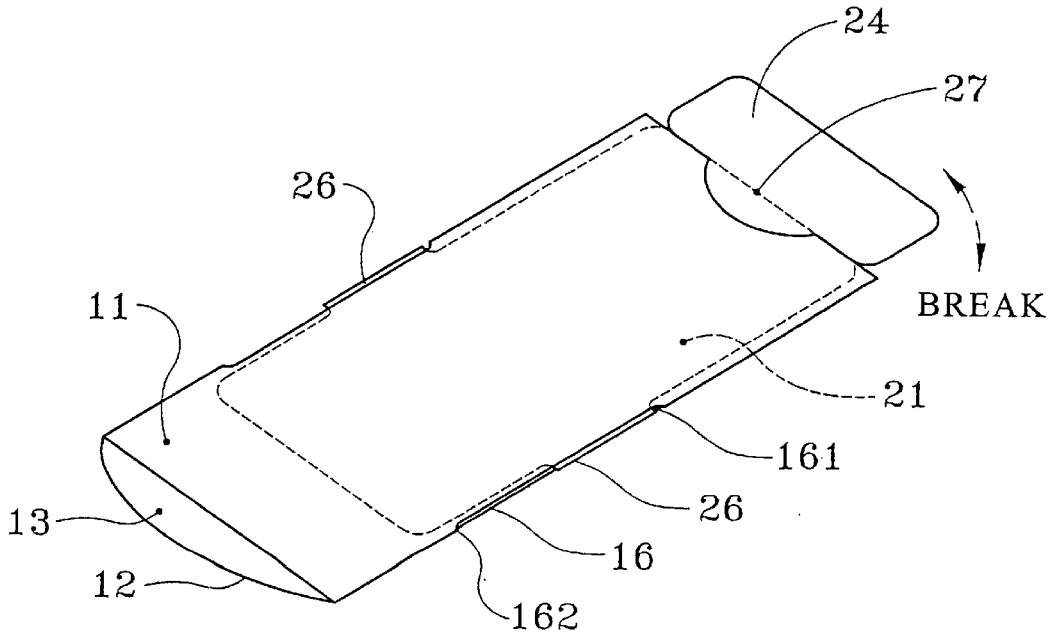
FIG. 2 is a view of the dispenser in FIG. 1 with the pack partially taken out of the case to show the removable sealing part.

In FIGS. 1 and 2, on the joins of the rear 11 and front 12 faces of the case 1, slots 16 each comprising a first end 161 and a second end 162 are formed. The function of these slots will be given below.

In addition, the front face 12 of the case 1 is relatively flexible and can form a deformable actuation wall which it is possible to press using a finger to indent it.

The fluid product pack 2 placed inside the case 1 comprises, according to an advantageous embodiment, a thermoformed body connected to a covering film so as to define a container for the fluid product together and a dispensing orifice through which the fluid product may be removed from the container. The thermoformed body may advantageously define a deformable actuation wall which it is possible to deform to reduce the volume of the container and thus deliver the fluid product stored inside through the dispensing orifice.

The dispensing orifice of the pack 2 is sealed before use by a removable sealing part 24 which is connected to the remainder of the pack by a lower-resistance line 27. It is thus possible to fold back, break or tear off the removable sealing part 24 along the line 27 to open the dispensing orifice.

The pack 2 is placed inside the case 1 with the thermoformed body turned towards the front face 12 and the covering film turned towards the rear face 11. The convex shape of the front face 12 of the case 1 is explained by the fact that the thermoformed body forms a projecting raised surface useful to define the container. Conversely, the rear face 11 is plane and extends in contact with the covering film which is in turn totally plane.

Figure 3:
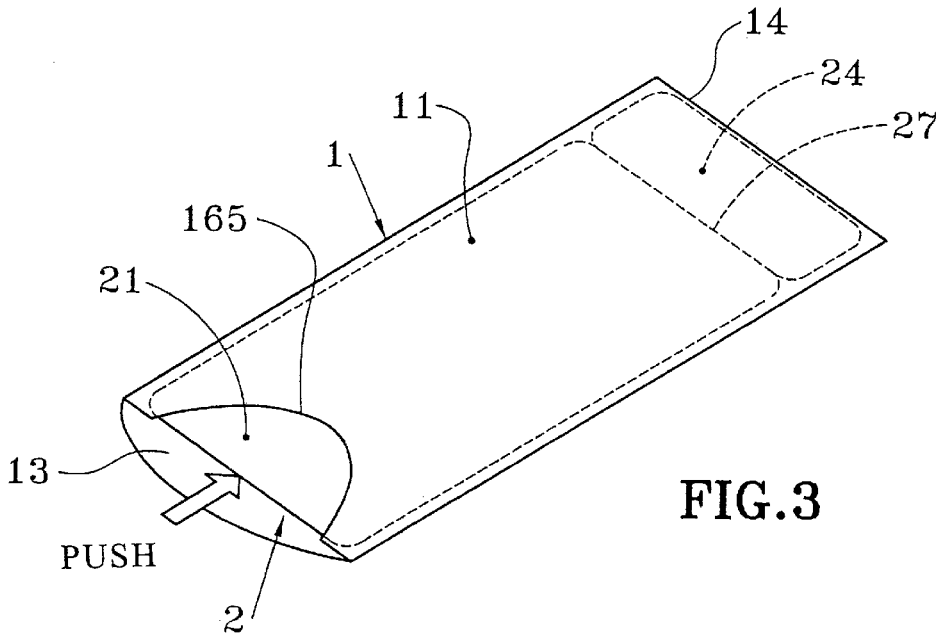
FIG. 3 is a view similar to FIG. 1 for a second embodiment of the present invention.

It can be seen in FIGS. 1 and 3 that the length of the case 1 is approximately equal to the length of the pack 2 and its width is slightly greater. The pack 2 is thus completely covered by the case 1 and this is particularly true on the front face 12. As a result, in the unused state shown in FIGS. 1 and 3, the case covers the removable sealing part 24.

In the embodiment shown in FIGS. 1 and 2, the pack also comprises two lateral tabs 26 projecting laterally outside in opposite directions. These tabs 26 are inserted inside the slots 16 formed by the case 1. The width of the pack 2 at the tabs 26 is greater than the width of the case 1 such that the tabs 26 project from either side of the case 1 through the slots 16.

The length of the slots 16 of the case 1 is greater than the length of the tabs 26 such that the tabs 26 may be moved inside the slots 16 like slides. Therefore, these slides 26 can move between the two ends 161 and 162 of the slots 16. It is easy to understand that the sliding of the pack 2 inside the case 1 is limited by the insertion of the slides 26 inside the slots 16, and more particularly by the stopping of the slides 26 with the ends 161 and 162 of the slots 16.

In the embodiment in FIGS. 1 and 2, the slides 26 are at a stop with the ends 162 of the slots 16 when the pack is in its initial state, entirely housed inside the pack 1 as shown in FIG. 1. However, the slides 26 come to a stop at the ends 161 of the slots 16 when the removable sealing part 24 is taken out by sliding it out of the case 1. Advantageously, the stop of the slides 26 on the ends 161 corresponds to the alignment of the lower-distance line 27 with the end 14 of the case 1 so as to uncover only the removable sealing part 24.

In the embodiment in FIGS. 1 and 2, the pack 2 may be taken out of the case 1 by pulling on the pack 2 by holding it at its removable sealing part 24, and more particularly at a part 25 of said removable sealing part 24. This part 25 of the removable sealing part is rendered visible by a slot on the case 1 on its rear face 11 on the edge of the opening 14. It is thus possible to hold the pack 2 at the part 25 through the slot 15 on the case 1. By holding the part 25, the user can pull on the pack so as to slide it inside the case 1. The sliding of the pack 2 inside the case will be rapidly limited by the slides 26 coming to a stop against the ends 161 of the slots 16 of the case 1. This corresponds to the state shown in FIG. 2 and the user can fold back, break or tear off the removable sealing part 24 projecting outside the case 1 up to the lower-resistance line 27. When the removable sealing part 24 is torn off, the dispenser is returned to its original configuration characterised by the case 1.

It is also possible to slide the pack in the case by means of the slides 26 projecting outside the slots, by holding the pack by the slides and pulling. The slot 25 is then no longer necessary to pull on the pack.

It should be noted that the user in the presence of a dispenser according to FIGS. 1 and 2 cannot push the pack 2 inside the case 1 given that the slides 26 are at a stop against the ends 162 of the slots 16 in the initial position wherein the pack 2 is entirely comprised inside the case 1. The slot ends 162 thus form means preventing push-type sliding of the pack 2 inside the case 1. The other slot ends 161, for their part, form pull-type sliding stopping means after a limited sliding distance. The combination of prevention and stopping means imposes on the user an obligatory sliding direction to take the pack out of the case.

It is naturally possible to imagine other embodiments for the stopping and/or prevention means involving the interaction of the pack 2 and the case 1.

Figure 4:
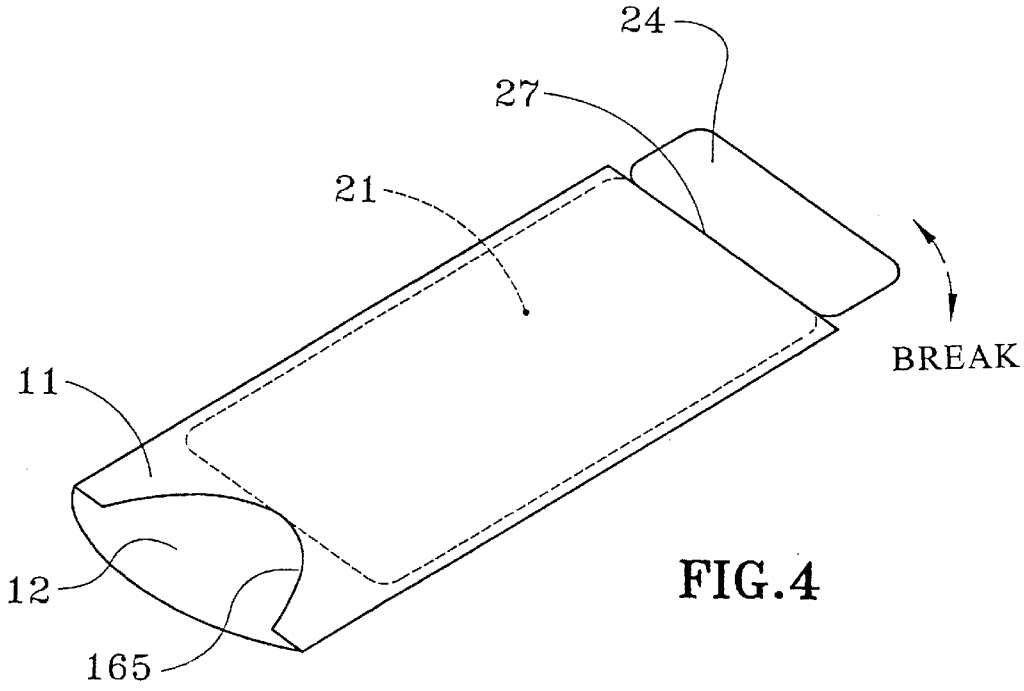
FIG. 4 is a view similar to that in FIG. 2 for the dispenser according to the second embodiment in FIG. 3.

We will now refer to FIGS. 3 and 4 which show a second embodiment of the invention. The pack 2 inside the case 1 may be approximately identical to that in FIGS. 1 and 2, i.e. with a thermoformed body covered with a film, a sealing part 24 being connected in a removable manner to the remainder of the pack 2 with a lower-resistance line 27 enabling the sealing part 24 to be folded back, broken or torn off along the line 27.

However, the pack 2 of this second embodiment differs from that in FIGS. 1 and 2 in that it has no lateral tabs 26 forming slides.

As regards the case 1, it differs from that in FIGS. 1 and 2 in that it has no lateral slots 16 and the slot 25 at the opening 14. However, the case 1 comprises a notch 165 located on the rear face 11 at the opening 13. The pack 2 is visible and accessible through the notch 165. More specifically, the lower part of the covering film 21 opposite the removable sealing part 24 is visible through the notch 165.

For example, by pushing the pack 2 using a finger at the notch 165, the pack is moved by sliding inside the case 1 so as to take the removable sealing part 24 out of the case 1 at the other end 14. The user can push on the pack until their finger comes to a stop against the edge of the notch 165 which thus forms push-type stopping means. When the lower edge of the pack is aligned with the rear of the notch 165, the removable sealing part 24 is entirely taken out of the case 1 with the lower-resistance line 27 aligned with the edge of the opening 14.

In this second embodiment, the push-type stopping means do not incorporate means preventing pull-type sliding on the pack 2 to take it out of the case 1. The embodiment in FIGS. 3 and 4 is a very simple embodiment which is extremely easy to produce.

However, it is possible on the same dispenser to combine the push-type notch 165 in FIGS. 3 and 4 with the system of slides 26 inserted in the slots 16 in FIGS. 1 and 2. In other words, and more generally, it is possible to combine the notch 165 with push-type stopping means incorporating advantageously or optionally means to prevent the pack from being taken out by pulling. For example, by incorporating the system of slides and slots in FIGS. 1 and 2 in the embodiment in FIGS. 1 and 2 in the embodiment in FIGS. 3 and 4, it is impossible to slide the pack by pulling on the pack at the notch 165 given that the slides 26 are initially at a stop against the slot ends 162. Conversely, it is possible to push on the pack so as to slide the slides 26 in the slots 16 until they come to a stop against the slot ends 161. The slides 26 coming to a stop against the ends 161 may advantageously correspond with the alignment of the lower edge of the pack with the rear of the notch 165. In this case, two push-type stopping means are incorporated in the same dispenser, which does not pose a problem. It is also envisaged that the slots 16 are longer at the ends 16 such that the slides 26 do not come to a stop at the slot ends 161 when the lower edge of the pack 2 is aligned with the rear of the notch 165. In this case, the slide and slot system only performs one function to prevent the pack from being pulled out.

The pull-type or push-type stopping means, advantageously combined with sliding prevention means, enable easier use of such a dispenser by imposing a direction and limiting the sliding of the pack inside the case.

What is claimed is:

1. Fluid product dispenser comprising:

a fluid product pack (2) defining a fluid product container, a dispensing orifice, and a removable sealing part (25) sealing the dispensing orifice, a case (1) wherein the fluid product pack (2) is inserted and slidable so that the pack is sufficiently taken out of the case to remove the removable sealing part, characterised in that stopping means (16, 26, 265) are provided to allow a limited sliding of the pack in the case, so that at least the removable sealing part is taken out of the pack, with the stopping means in an operating condition.

2. Dispenser according to claim 1, wherein the stopping means (16, 26) comprise pull-type sliding stopping means on the pack to limit the sliding of the pack relative to the case in a withdrawal direction of the pack.

3. Dispenser according to claim 2, wherein the pull-type sliding stopping means comprise push-type sliding prevention means on the pack to limit the sliding of the pack relative to the case in an insertion direction of the pack.

4. Dispenser according to claim 1, wherein the case comprises holding means to hold the pack when pulling it out of the case.

5. Dispenser according to claim 4, wherein the holding means comprise a slot (15) on the case (1) uncovering the pack to hold it at the sealing part (25).

6. Dispenser according to claim 1, wherein the stopping means comprise push-type sliding stopping means on the pack to limit the sliding of the pack relative to the case.

7. Dispenser according to claim 6, wherein the stopping means comprise a notch (165) on the case uncovering the pack to limit the extent that the pack can be pushed.

8. Dispenser according to claim 2, wherein the stopping means comprise at least one slide (26) inserted in a respective slot (16) comprising at least one slot end (161) against which the slide comes to a stop at the end of sliding.

9. Dispenser according to claim 7, wherein the push-type stopping means comprise pull-type sliding prevention means on the pack to further limit the sliding of the pack relative to the case.

10. Dispenser according to claim 3, wherein the prevention means comprise at least one slide (26) inserted in a respective slot (16) comprising a second slot end (162) against which the slide is at a stop at the start of sliding.

11. Dispenser according to claim 1, wherein the stopping means limit the sliding of the pack out of the case so as only to uncover the removable sealing part (25).

12. Dispenser according to claim 1, wherein the case (1) forms a sheath open on two opposite ends (13, 14).

13. The fluid product dispenser according to claim 1, wherein an portion of the sealing part exposed from the case when the pack is fully inserted in the case so that the exposed portion of the sealing part can be held for sliding the pack relative to the case.

14. The fluid product dispenser according to claim 13, wherein case includes a slot to expose the portion of the sealing part.

15. A fluid product dispenser, comprising:

a fluid product pack containing a fluid, having a dispensing orifice, and having a removable seal sealing the orifice;

a case in which the fluid product pack is slidably received, the removable seal accessible upon sliding the fluid pack partially outside the case; and stopping elements, comprising a slide and a slot that limit sliding displacement of the fluid product pack within the case.

16. A fluid product dispenser, comprising:

a fluid product pack containing a fluid, having a dispensing orifice, and having a removable seal sealing the orifice;

a case in which the fluid product pack is slidably received, the removable seal accessible upon sliding the fluid pack partially outside the case; and a push-type notch with a closed end and an opened end, with the opened end disposed at one side of the case, and wherein the push-type notch exposes part of the fluid product pack for access by a user's finger, and the closed end acts as a stop to limit a distance the user's finger travels when pushing the fluid product pack out of the case.

* * * * *